US006795024B2

(12) United States Patent
Gottwald et al.

(10) Patent No.: US 6,795,024 B2
(45) Date of Patent: Sep. 21, 2004

(54) ANTENNA FOR SATELLITE RECEPTION

(75) Inventors: Gerd Gottwald, Wannweil (DE); Martin Kuhn, Stuttgart (DE); Peter Riedhofer, Metzingen (DE)

(73) Assignee: Hirshmann Electronics GmbH & Co. KG, Neckartenzlingen (DE)

( * ) Notice: Subject to any disclaimer, the term of this patent is extended or adjusted under 35 U.S.C. 154(b) by 0 days.

(21) Appl. No.: 10/179,030

(22) Filed: Jun. 26, 2002

(65) Prior Publication Data

US 2003/0011526 A1 Jan. 16, 2003

(30) Foreign Application Priority Data

Jul. 11, 2001 (DE) ..... 101 33 735

(51) Int. Cl.[7] ..... H01Q 1/38
(52) U.S. Cl. ..... 343/700 MS; 343/789
(58) Field of Search ..... 343/700 MS, 789

(56) References Cited

U.S. PATENT DOCUMENTS 4,369,447 A * 1/1983 Edney ..... 343/769

FOREIGN PATENT DOCUMENTS

DE 43 06 056 A1 9/1993

OTHER PUBLICATIONS

Misao Haneishi, Shinichiro Yoshida and Masashi Tabeta, *A Design of Back–Feed Type Circularly Polarized Microstrip Disk Antennas Having Symmetrical Perturbation Element by One–Point Feed,* (Electronics and Communications in Japan, Nov. 7, 1981, pp. 52–60, vol. 64–B, Scripta Publishing Co.).

R.B. Waterhouse, *Small Printed Antenna Easily Integrated into a Mobile Handset Terminal,* (Electronics Letters, Aug. 20, 1998, pp. 1629–1631, Vo. 34, No. 17).

Bashir, M. et al., *Flache Kombi–antenne für GSM und GPS,* Funkschau 2/95, pp. 60–62.

* cited by examiner

*Primary Examiner*—Michael C. Wimer
(74) *Attorney, Agent, or Firm*—Fulbright & Jaworski, L.L.P.

(57) ABSTRACT

An antenna for receiving electromagnetic waves, the antenna including a resonator having an electrically conductive bottom, an electrically conductive top, and an electrically nonconductive section between an electrically conductive side wall and the electrically conductive top. The electrically conductive bottom being in electrical contact with the electrically conductive side wall, which extends from the electrically conductive bottom to a grounding surface. The resonator having a dielectric disposed in an interior volume.

19 Claims, 1 Drawing Sheet

ANTENNA FOR SATELLITE RECEPTION

BACKGROUND OF THE INVENTION

1. Field of the Invention

The present invention relates to an antenna for receiving electromagnetic waves in the gigahertz range, and more particularly to an antenna and grounding surface arrangement to accommodate reception of circularly or vertically polarized electromagnetic waves.

2. Description of the Related Technology

Antennas, especially mobile antennas located in or on motor vehicles, for receiving circularly polarized electromagnetic waves emitted from satellites, or vertically polarized electromagnetic waves emitted from terrestrial transmitters, are known. A problem arising with such vehicle mounted antennas is that the direction to the one or more emitting satellites or transmitters cannot be determined beforehand. Therefore, the known antennas with small angular cones of reception suffer from reception interruptions when there are travel direction changes with respect to one or more satellites. In such circumstances there may be only emissions from one satellite that can be received, or there can be complete interruption of reception from any satellite or terrestrial transmitter.

SUMMARY OF THE INVENTION

An object of the invention is to provide an antenna that avoids the above described disadvantages, i.e. an antenna that provides almost uninterrupted reception of electromagnetic waves.

The antenna of the invention includes a resonator having an electrically nonconductive opening. The antenna resonator of the invention is located over a grounding surface to receive right- or left-circularly polarized electromagnetic waves within a conical directional pattern having an vertex angle of up to 160°. The conical directional pattern is perpendicular to the grounding surface. In part, the antenna resonator includes a resonator cup with a dielectric. Received electromagnetic waves pass through the electrically nonconductive opening into the resonator. The antenna resonator includes a dielectric and, in part, can also contain air, which can ensure especially high quality optimum reception of electromagnetic waves. Moreover, due to the configuration of the resonator with its resonator cup which holds the dielectric, it is feasible to receive circularly polarized electromagnetic waves in the gigahertz range within a conical directional pattern having a very large vertex angle, for example of up to 160°. In this way a mobile arrangement of the antenna in relation to an individual satellite, or also two or more satellites far from one another, can receive electromagnetic waves without difficulty. Based on the implemented conical directional pattern having a large vertex angle, almost interference-free and mainly uninterrupted reception of satellite signals is possible. In addition, omnidirectional reception of vertically polarized electromagnetic waves at even extremely flat angles of incidence which can be present when the signals are emitted from stationary terrestrial transmitters is possible.

For one embodiment of the invention, the dielectric has an electrically conductive coating which includes a nonconductive opening portion to the resonator for injection electromagnetic waves. The opening is for example made as a peripheral gap or slot. The dielectric itself may be for example a circuit board which is coated with an electrically conductive layer (for example, made of copper), or may be a hexaflouride (HF) substrate, such as for example TEFLON®, which can be coated with an electrically conductive layer. Based on the configuration of the dielectric a large bandwidth may be received. At the same time, high reproducibility of the electrical properties can be achieved, especially in serial production of the antenna. Moreover, the dielectric with its peripheral gap nonconductive opening, and with its electrically conductive coating can be produced easily and economically. In a preferred embodiment of the invention the dielectric is held in a peripheral recess of a resonator cup. In this way the dielectric, when the antenna is installed, can be inserted or pressed into the peripheral recess so that economical production of the antenna is ensured.

In a preferred embodiment of the invention the dielectric is located parallel and above a bottom of the resonator cup. The electrically nonconductive opening of the resonator is raised over the grounding surface by a certain number of wavelengths in order to achieve the desired directional pattern. Here the dielectric is advantageously located roughly 0.05 to 0.5 wavelengths above the bottom of the resonator cup. Depending on the desired directional pattern, therefore the peripheral recess in the resonator cup can be located at a corresponding distance above the bottom of the resonator cup. This corresponding distance can be provided by there already being a peripheral recess when the resonator cup is manufactured, or the peripheral recess can be made subsequently, after production of the resonator cup.

In a preferred embodiment of the invention an electrical connection to the antenna is arranged symmetrically with respect to the resonator cup, especially with respect to the dielectric. This symmetrical arrangement of the electrical connection enables matching to the characteristic wave impedance, for example a wave impedance of 50 ohms.

In a preferred embodiment of the invention the resonator cup is made as a pressure diecasting. This has the advantage that on the one hand a pressure diecasting with a highly conductive surface can be produced, while such pressure diecasting requires only little or no reworking so that in this way production costs are reduced. In addition, such pressure in diecasting meets mechanical requirements (such as especially impacts or vibrations) in mobile use of the antenna in motor vehicles.

In a preferred embodiment of the invention, the antenna is located in a housing, and the antenna in its housing can be located on the outside skin of a motor vehicle. Alternatively or in addition (especially when there are to be several antennas in or on the motor vehicle) the antenna can also be located underneath an electrically nonconductive outside skin of the motor vehicle. It is especially advantageous here if an antenna amplifier is located within the resonator cup or within the housing of the antenna. In this way an antenna module can be produced which can be checked for its serviceability and which is supplied to the motor vehicle manufacturer for installation in new vehicles or for subsequent installation.

BRIEF DESCRIPTION OF THE DRAWINGS

One embodiment of a structural version of an antenna according to the invention, which the invention is not limited to and to which differences therefrom may occur to one skilled in the art without departing from the scope of the invention is described below and explained using the Figure, wherein.

DETAILED DESCRIPTION

Figure 1:
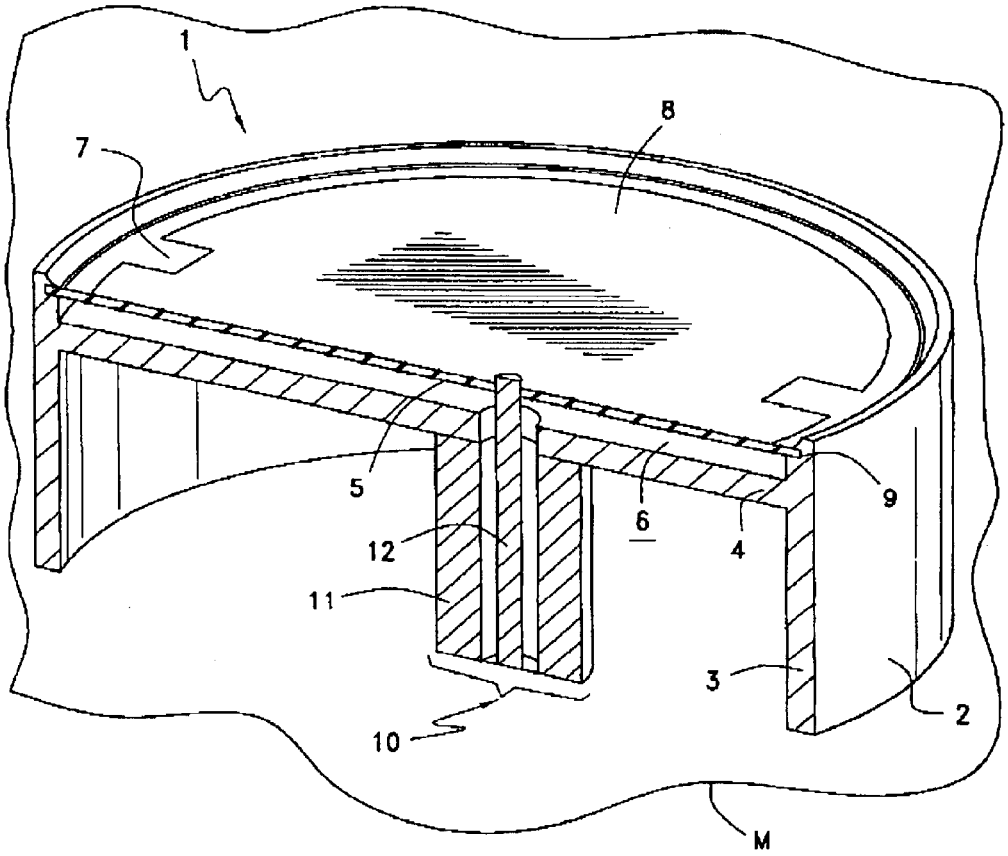
FIG. 1 is a perspective sectional view of a preferred embodiment of an antenna according to the invention.

A modified patch antenna is shown in a perspective sectional view in FIG. 1, the antenna is labeled with general reference numeral 1. Antenna 1 has an essentially cylindrical structure. A resonator cup 2 here consists essentially of a peripheral side wall 3 (cylindrical) with a bottom 4 roughly at a right angle to the peripheral side wall 3. The side wall 3 with a smaller part is above the bottom 4 and with a larger part is underneath the bottom 4. This resonator cup 2 is made for example as a pressure diecasting, the surface being highly conductive. In the sectional view shown in FIG. 1 conductive areas are shown by uniform narrow cross-hatching. The antenna 1 is located towards a grounding surface M, which can be for example the body of the motor vehicle.

Above the bottom 4 is a dielectric 5 which is spaced apart from the bottom 4 and which thus forms a resonator 6. As shown in FIG. 1 in a sectional view, dielectric 5 has uniform thick cross-hatching. The dielectric 5 consists of an electrically nonconductive material which extends to the surface of the dielectric 5 when the patch antenna 1 is viewed from overhead. Viewed from the top therefore an electrically nonconductive area 7, especially a peripheral gap, can be recognized, the area next to the electrically nonconductive area 7 being made as an electrically conductive area 8. The electrically conductive top area 8 or several areas consists of a coating which is applied to the dielectric 5. The dielectric 5 is held in a peripheral recess 9 in the resonator cup 2. The dielectric 5 can be clipped into the peripheral recess 9. It is also being conceivable that on the top edge of the side wall 3 of the resonator cup 2 a step is made, for example, milled in, on which the dielectric 5 is placed. Then the dielectric 5 can be fixed by a sealing ring or also for example by cementing on the side wall 3.

Furthermore, it is shown in FIG. 1 that symmetrical to the resonator cup 2, especially to the side wall 3, roughly in the middle area of the patch antenna 1 there is an electrical connection 10 which is made coaxially by an outside lead 11 and by an inside lead 12. Via this electrical connection 10 which is shown also schematically for purposes of better representation, the received signals can be supplied to an antenna amplifier (not shown) for further processing. In this case the antenna amplifier would be a component which is external to the patch antenna 1. Attentively, it is also possible to integrate the antenna amplifier with its mechanical and electronic elements within the resonator cup 2. For this purpose the resonator cup 2, especially the bottom 4, can form at least in part a circuit board (not shown) of the antenna amplifier on which its electronic components are located. Alternatively, the bottom 4 of the resonator 6 can form the support surface of the circuit board of the antenna amplifier.

This means that the circuit board of the antenna amplifier at the same time forms part of the bottom 4 of the resonator 6. In this way the patch antenna 1 and the antenna amplifier can be produced, tested and delivered as a module. In addition, it is still conceivable for the patch antenna 1 with or without the antenna amplifier to be located in a housing (not shown). This multi-part housing, as an additional component, can surround the patch antenna 1 and can be made as an injection molding, especially of plastic. Moreover it is also feasible for the patch antenna 1, with or without the antenna amplifier, to be located underneath a nonconductive outside skin of a vehicle, especially in areas where the contour of the outside vehicle skin does not interfere with the reception of electromagnetic waves, such as on the vehicle roof. In this arrangement the patch antenna 1 can in part be countersunk into the roof of the vehicle and in part can be covered by the housing.

One important application of the antenna of the present invention therefore is in the field of mobile reception of electromagnetic waves in the gigahertz range for motor vehicles, other mobile and non-mobile applications not being precluded.

What is claimed is:

1. An antenna for receiving electromagnetic waves, said antenna comprising:

a first resonator having an electrically conductive bottom, electrically conductive side wall said electrically conductive bottom being in electrical contact with said electrically conductive side wall, and an electrically conductive top disposed above said electrically conductive bottom, said electrically conductive top not in electrical contact with said electrically conductive side wall;

a second resonator disposed back-to-back with said first resonator, said second resonator having said electrically conductive bottom in electrical contact with said electrically conductive side wall;

said first resonator having a first dielectric disposed to be in contact with said electrically conductive top and not in contact with said electrically conductive bottom; and said electrically conductive side wall extending to a grounding surface.

2. The antenna according to claim 1, further comprising a second dielectric disposed in said first resonator between said first dielectric and said electrically conductive bottom, wherein said second dielectric is air.

3. The antenna according to claim 1, wherein the electromagnetic waves are circularly polarized and are received by said resonator within a cone having an angle from a vertex of the cone that extends to at least 160°, the cone being substantially symmetric about an axis that extends perpendicular to a surface parallel to said grounding surface.

4. The antenna according to claim 1, wherein the electromagnetic waves are right circularly polarized.

5. The antenna according to claim 1, wherein the electromagnetic waves are left circularly polarized.

6. The antenna according to claim 1, wherein the electromagnetic waves are vertically polarized.

7. The antenna according to claim 1, further compromising:

a recess disposed in said electrically conductive side wall of said first resonator with said first dielectric having an exterior edge portion disposed in said recess.

8. The antenna according to claim 7, wherein said first dielectric is a circuit board.

9. The antenna according to claim 7, wherein an electrically nonconductive section extends from said electrically conductive side wall of said first resonator to an edge of said electrically conductive top of said first resonator disposed on said first dielectric.

10. The antenna according to claim 7, wherein said first dielectric has a surface parallel to said electrically conductive bottom.

11. The antenna according to claim 1, further comprising:

a coaxial electrical connection to said first resonator, said coaxial connection including an inside lead electrically connected to said electrically conductive top and an outside lead electrically connected to said electrically conductive bottom.

12. The antenna according to claim 11, wherein said coaxial connection has said inside lead electrically connected to said electrically conductive top at a location that is substantially symmetrically equidistant from said electrically conductive side wall, and has said outside lead electrically connected to said electrically conductive bottom at a location that is substantially symmetrically equidistant from said electrically conductive side wall.

13. The antenna according to claim 1, further comprising:

a third dielectric on which said electrically conductive bottom is disposed; and, said third dielectric being disposed outside said first resonator and inside said second resonator.

14. The antenna according to claim 13, further comprising:

an antenna amplifier; and, said antenna amplifier being disposed on said second third dielectric.

15. The antenna according to claim 1, wherein said first and second resonators are made as a pressure diecasting.

16. The antenna according to claim 1, wherein said first and second resonators and grounding plane are disposed on a motor vehicle.

17. The antenna according to claim 1, wherein said electrically conductive top is disposed from said electrically conductive bottom by at least 0.05 wavelengths of received electromagnetic waves.

18. The antenna according to claim 1, wherein said electrically conductive top is disposed from said electrically conductive bottom by no more than 0.5 wavelengths of received electromagnetic waves.

19. The antenna according to claim 12, wherein said coaxial connection substantially matches a characteristic wave impedance.

* * * * *